US009824648B2

(12) United States Patent
Hsieh et al.

(10) Patent No.: US 9,824,648 B2
(45) Date of Patent: Nov. 21, 2017

(54) TRANSPARENT DISPLAY APPARATUS AND METHOD FOR DRIVING TRANSPARENT DISPLAY PANEL THEREOF

(71) Applicant: Chunghwa Picture Tubes, LTD., Taoyuan (TW)

(72) Inventors: Pei-Lin Hsieh, Taoyuan (TW); Hsiang-Tan Lin, Keelung (TW)

(73) Assignee: Chunghwa Picture Tubes, LTD., Taoyuan (TW)

( * ) Notice: Subject to any disclaimer, the term of this patent is extended or adjusted under 35 U.S.C. 154(b) by 176 days.

(21) Appl. No.: 14/919,729

(22) Filed: Oct. 22, 2015

(65) Prior Publication Data

US 2017/0069277 A1 Mar. 9, 2017

(30) Foreign Application Priority Data

Sep. 7, 2015 (CN) ..... 2015 1 0561371

(51) Int. Cl.
*G09G 3/36* (2006.01)

(52) U.S. Cl.
CPC ... *G09G 3/3607* (2013.01); *G09G 2320/0673* (2013.01)

(58) Field of Classification Search
CPC ..... G02F 1/1334; G09G 2320/0626; G09G 3/3607; G09G 3/3648; G09G 2320/0673
See application file for complete search history.

(56) References Cited

U.S. PATENT DOCUMENTS

2011/0109657 A1* 5/2011 Ogita ..... G02F 1/1334 345/690
2013/0147851 A1* 6/2013 Yim ..... H01L 27/32 345/690
2014/0184577 A1* 7/2014 Kim ..... G09G 5/10 345/207

(Continued)

FOREIGN PATENT DOCUMENTS

TW 201324484 6/2013
TW 201349126 12/2013

OTHER PUBLICATIONS

"Office Action of Taiwan Counterpart Application", dated Oct. 14, 2016, p. 1-p. 5.

*Primary Examiner* — Hong Zhou
(74) *Attorney, Agent, or Firm* — JCIPRNET

(57) ABSTRACT

A transparent display apparatus and a method for driving transparent display panel thereof are provided. The transparent display apparatus includes a transparent display panel, an image processor and a display driver. The image processor receives a display data signal having multiple display data and a transparency control signal having transparency values to provide multiple driving data. When each of display data corresponds to a transparent state, the image processor sets the corresponding driving data according to a predetermined transparent state gray-level corresponding. When each of display data corresponds to a non-transparent state, the image processor transforms the each of display data into the driving data corresponding to the non-transparent state. The display driver drives the transparent display panel to display a display frame having all gradations of a black state, a white state and the transparent state according the driving data.

4 Claims, 3 Drawing Sheets

(56) References Cited

U.S. PATENT DOCUMENTS

| | | | | |
|---|---|---|---|---|
| 2015/0192835 | A1* | 7/2015 | Kim | G09G 3/3208 345/589 |
| 2015/0373480 | A1* | 12/2015 | Park | H04W 4/005 715/748 |
| 2016/0027388 | A1* | 1/2016 | Seo | G09G 3/20 345/690 |

* cited by examiner

TRANSPARENT DISPLAY APPARATUS AND METHOD FOR DRIVING TRANSPARENT DISPLAY PANEL THEREOF

CROSS-REFERENCE TO RELATED APPLICATION

This application claims the priority benefit of China application serial no. 201510561371.1, filed on Sep. 7, 2015. The entirety of the above-mentioned patent application is hereby incorporated by reference herein and made a part of this specification.

BACKGROUND

Field of the Invention

The invention is directed to a display technique and more particularly, to a transparent display apparatus and a method for driving a transparent display panel thereof.

Description of Related Art

Liquid crystal displays (LCDs) may generally classified as three types, i.e., reflective LCDs, transmissive LCDs and transflective LCDs. With the increase of the display applications, transparent display panels have been developed in recent years. The transparent display panels have sufficient transmittance, and therefore, users can view through the transparent display panels and can observe background deployment in back of the transparent display panels. In addition to the originally transparent display functions, the transparent display panels can also be applied to display messages and draw more and more attention from the market.

In a current transparent display technique, grey-levels of an image frame can be transferred to transparency, and the image frame can be displayed according to the transparency of the transparent display panel. Taking a transparent display panel applied to a lightbox for example, a maximum gray-level (i.e., a white state, capable of displaying the white color) may be applied to present the greatest transparency (i.e., a transparent state), but leads to the white state being incapable of truly presented, while in another transparent display panel, a minimum gray-level (i.e., black state) may be applied to present the transparent state, but leads to the black state being incapable of truly presented.

Accordingly in the current display technique, once the type of the transparent display panel is determined, one of the black state and the white state cannot be presented. In addition, due to the transparency of the transparent display panel depending on the gray-levels, the transparency adjustment of the transparent display panel is limited. In this way, the display effect and user experiences of the transparent display panel will be dramatically influenced.

SUMMARY

The invention provides a transparent display apparatus and a method for driving a transparent display panel thereof which can drive the transparent display panel to display image frame having a black state, a white state and a transparent state to enhance a display effect and user experiences of the transparent display apparatus.

According to an embodiment of the invention, a transparent display apparatus including a transparent display panel, an image processor and a display driver is provided. The image processor receives a display data signal having a plurality of display data and a transparency control signal having a plurality of transparency values to provide a plurality of driving data. When each of the transparency values indicates that each of the display data corresponds to a transparent state, the image processor sets the corresponding driving data according to a predetermined transparent state gray-level. When each of the transparency values indicates that each of the display data corresponds to a non-transparent state, the image processor transforms each of the display data into the driving data corresponding to the non-transparent state. The display driver is coupled to the transparent display panel and the image processor to drive the transparent display panel to display a display frame having all gradations of a black state, a white state and the transparent state according the driving data.

According to an embodiment of the invention, a method for driving a transparent display panel is provided, and the method includes the following steps. A display data signal having a plurality of display data and a transparency control signal having a plurality of transparency values are received. When each of the transparency values indicates that each of the display data corresponds to a transparent state, corresponding driving data among a plurality of driving data is set according to a predetermined gray-level through an image processor. When each of the transparency values indicates that each of the display data corresponds to a non-transparent state, each of the display data is transformed into the driving data not corresponding to the transparent state through the image processor. The transparent display panel is driven to display a display frame having all gradations of a black state, a white state and the transparent state according the driving data through a display driver.

To sum up, in the transparent display apparatus and the method for driving the transparent display panel thereof provided by the embodiments of the invention, whether the display data corresponds to the transparent state or the non-transparent state can be determined according to the transparency control signal, such that the processing of the display data can be decided, and the driving data can be correspondingly generated. Thereby, the transparent display panel can display the image frame having the black state, the white state and the transparent state to enhance the display effect and the user experiences of the transparent display apparatus.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
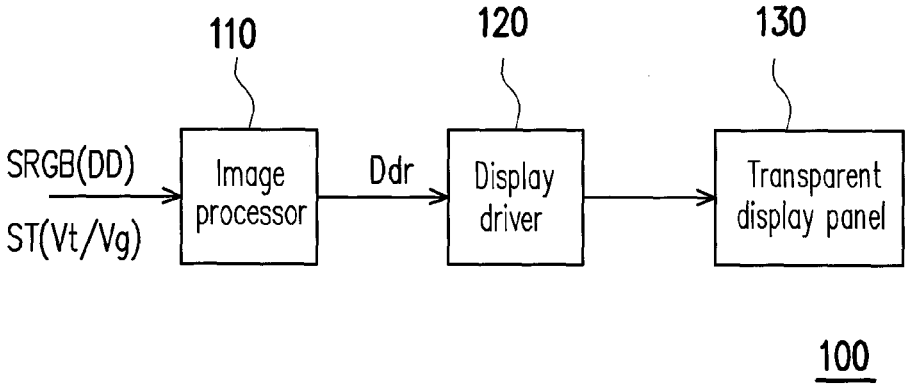
FIG. 1 is a schematic diagram illustrating a transparent display apparatus according to an embodiment of the invention.

FIG. 1 is a schematic diagram illustrating a transparent display apparatus according to an embodiment of the invention. Referring to FIG. 1, in the present embodiment, a transparent display apparatus 100 includes an image processor 110, a display driver 120 and a transparent display panel 130. The transparent display panel 130 is illustrated as a transparent display panel in which a gray-level "0" (i.e., a minimum gray-level) corresponds to a transparent state; however, in other embodiments, a transparent display panel in which a gray-level "255" or an arbitrary gray-level corresponds to the transparent state may be used for example, and other embodiments of the invention are not limited thereto.

The image processor 110 receives a display data signal SRGB having a plurality of display data DD and a transparency control signal ST having a plurality of transparency values Vt, and the image processor 110 provides a plurality of driving data Ddr to the display driver 120 according to the display data DD and the transparency values Vt. Therein, one display data DD corresponds to one transparency value Vt, and each transparency value Vt may be a digital value with one or more bits. Herein, each of the transparency values Vt is configured to indicate whether a corresponding pixel on the transparent display panel 130 presents the transparent state. Namely, the transparency control signal ST is configured to determine which areas on the transparent display panel 130 are transparent (i.e., present the transparent state) and which areas on the transparent display panel 130 are non-transparent (i.e., presents a brightness other than transparency). Meanwhile, the transparency control signal ST may be specified by a user or may calculate by using an algorithm to perform the determination according to the display data signal SRGB.

Then, when each of the transparency values Vt indicates that each display data DD corresponds to the pixel presenting the transparent state, the image processor 110 sets the corresponding driving data Ddr according to a predetermined transparent state gray-level corresponding. For example, each gray-level of the corresponding driving data Ddr is set to be identical to the predetermined gray-level. The predetermined gray-level may be a gray-level corresponding to the pixel presenting the transparent state (which is the gray-level "0" in this case), but the invention is not limited thereto. On the other end, when each of the transparency values Vt indicates that each display data DD corresponds to a pixel presenting a non-transparent state (e.g., a black state or a white state), the image processor 110 transforms the display data DD into the driving data Ddr corresponding to the non-transparent state. For example, the gray-level of the driving data Ddr is not the gray-level "0" to prevent the corresponding pixel from presenting the transparent state.

The display driver 120 is coupled to the image processor 110 and the transparent display panel 130 to drive the transparent display panel 130 to display a display frame having a black state, a white state and the transparent state according to the driving data Ddr.

Figure 2:
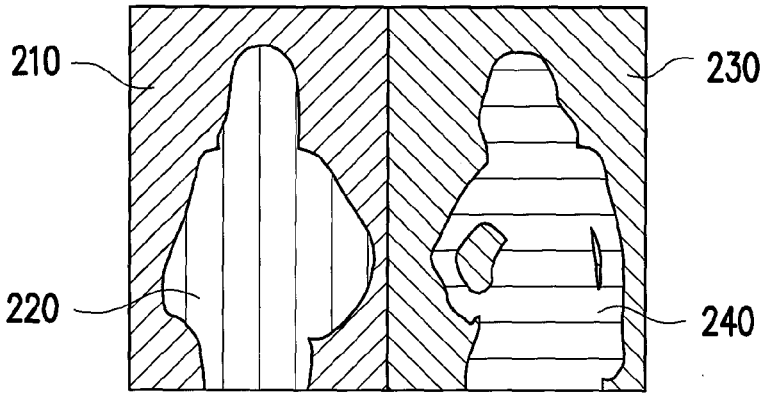
FIG. 2 is a schematic diagram illustrating an image frame of the display data signal according to an embodiment of the invention.
Figure 3:
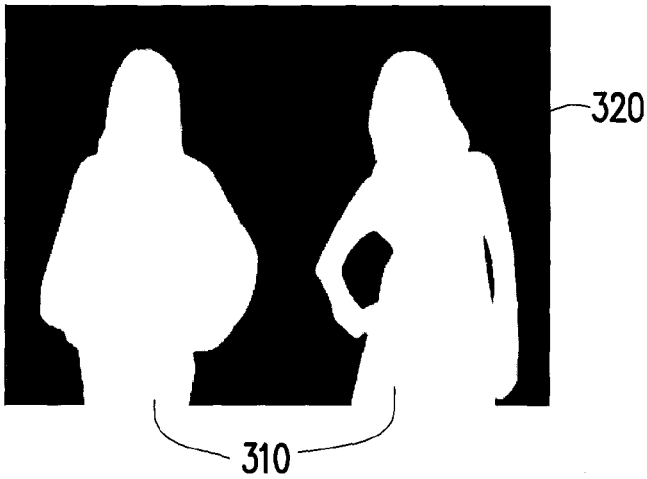
FIG. 3 is a schematic diagram illustrating an image frame of the transparency control signal according to an embodiment of the invention.
Figure 4:
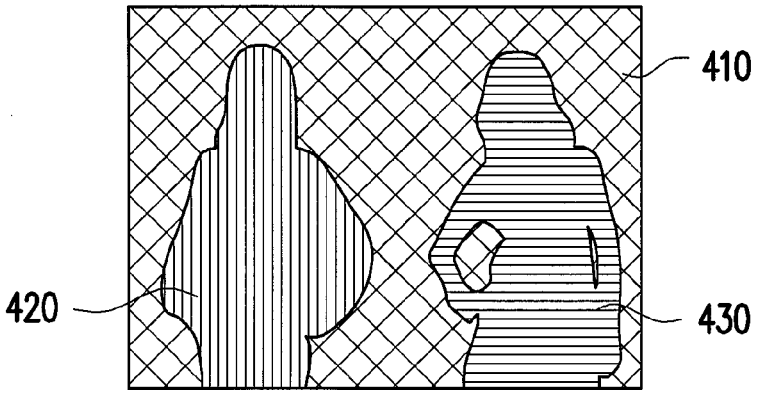
FIG. 4 is a schematic diagram illustrating an image frame of the driving data according to an embodiment of the invention.

FIG. 2 is a schematic diagram illustrating an image frame of the display data signal according to an embodiment of the invention. FIG. 3 is a schematic diagram illustrating an image frame of the transparency control signal according to an embodiment of the invention. FIG. 4 is a schematic diagram illustrating an image frame of the driving data according to an embodiment of the invention. Referring to FIG. 1 to FIG. 4, in the present embodiment, a foreground (including a black portrait 220 and a white portrait 240, for example) is set in the non-transparent state, i.e., as presented in a region 310, the transparency value Vt corresponding to each pixel in the region 310 may be represented by a bit of "1", while a background (i.e., a black background 210 and a white background 230) is set in a transparent state, as presented in a region 320, and the transparency value Vt corresponding to each pixel in the region 320 may be represented by a bit of "0". Then, the display data signal SRGB is adjusted according to the transparency control signal ST, such that the white background 230 in back of the white portrait 240 may be successfully designated in the transparent state. Namely, gray-levels of the black background 210 and the white background 230 are synchronously set in the transparent state (which is the gray-level "0"), as presented by a background 410.

Since the black portrait 220 may have display information with the gray-level "0", and the gray-level "0" in this case corresponds to the transparent state, display information corresponding to the black portrait may be modified as display information without the gray-level "0". Namely, the color of the black portrait 220 is pale (as presented by a black portrait 420). For example, a gray-level range corresponding to the black portrait 220 is adjusted to range from 5 to 255, such that the black portrait 220 does not become transparent. In the same way, the same image frame is displayed in the same display manner, the display information corresponding to the white portrait 240 is also modified, i.e., the color of the white portrait is also pale (as presented by a white portrait 430), as shown in FIG. 4.

Figure 5:
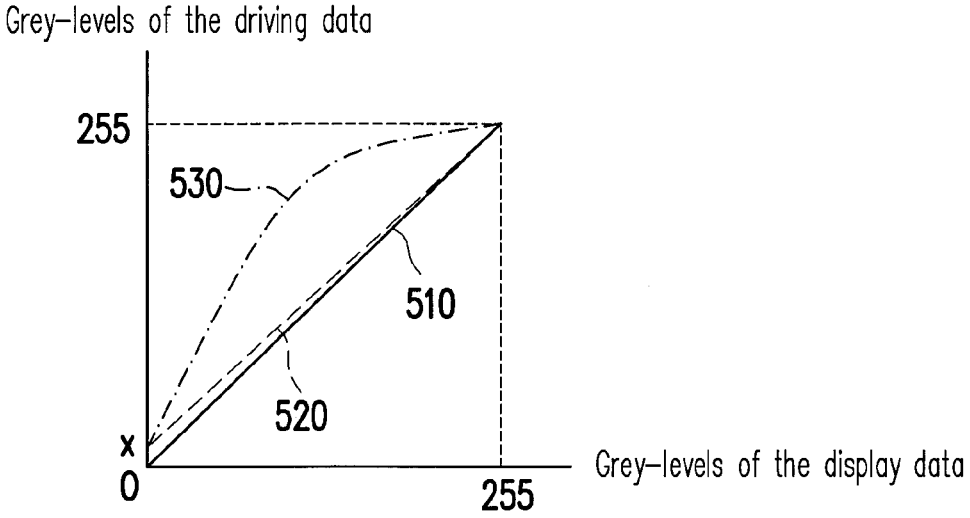
FIG. 5 is a schematic graph illustrating a Gamma curve according to an embodiment of the invention.

FIG. 5 is a schematic graph illustrating a Gamma curve according to an embodiment of the invention. Referring to FIG. 1 to FIG. 5, a Gamma curve 510 is an original Gamma curve, a Gamma curve 520 is a Gamma curve with an increased lower limit (i.e., the lower limit is not the gray-level "0"), and a Gamma curve 530 is a Gamma curve with an increased intermediate gray-level (i.e., the intermediate gray-level of the Gamma curve is adjusted toward a maximum gray-level "255"). In the present embodiment, when the transparency values Vt indicate that the display data DD corresponds to the pixels displaying the non-transparent state (as presented in the region 310), the image processor 110 transforms the display data DD into the driving data Ddr according to the Gamma curve 520. Namely, all the gray-levels of the driving data Ddr are linearly adjusted to limit the gray-levels corresponding to the non-transparent state to fall within a range from x to 255, so as to maintain the gradation of the image frame and avoid overflow, where x is a positive integer greater than 0.

In addition, the increase of the initial gray-level (i.e., the gray-level of the driving data Ddr corresponding to the display data DD having the gray-level "0") of the Gamma curve would lead to a decreased contrast, and thus, an intermediate brightness (i.e., the intermediate gray-level) of the Gamma curve may be increased (i.e., adjusted toward the maximum gray-level "255"), so as to calibrate the lost contrast, as presented by the Gamma curve 530. The contrast is equal to the maximum brightness divided by the minimum brightness, and the range of adjusting the intermediate gray-level may vary with characteristics of the display frame. For example, if the display frame tends to be bright, the adjustment range is small; if the display frame tends to be intermediate, the adjustment range is normal; and if the display frame tends to be dark, the adjustment range is large, but the invention is not limited thereto.

Figure 6:
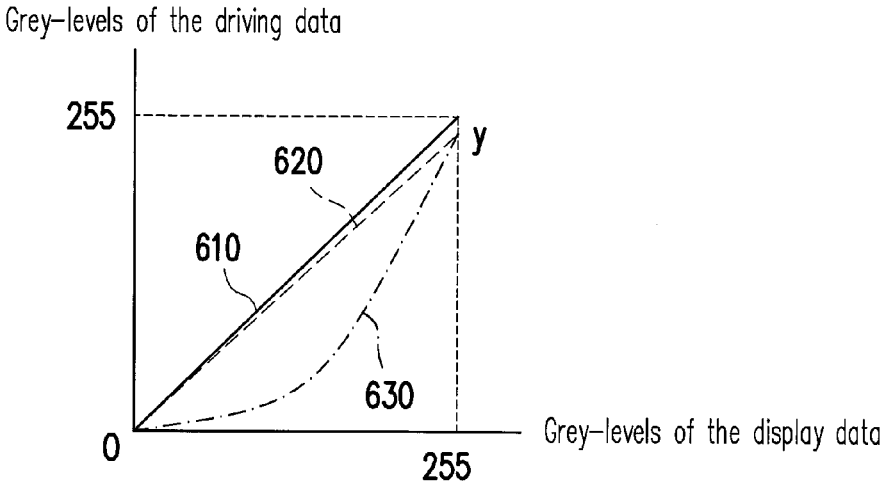
FIG. 6 is a schematic graph illustrating a Gamma curve according to another embodiment of the invention.

FIG. 6 is a schematic graph illustrating a Gamma curve according to another embodiment of the invention. Referring to FIG. 5 to FIG. 6, the embodiment illustrated in FIG. 5 is applied to the transparent display panel in which the gray-level "0" (i.e., the minimum gray-level) corresponds to the transparent state, for example, while the embodiment illustrated in FIG. 6 is applied to a transparent display panel in which the gray-level "255" (i.e., the maximum gray-level) corresponds to the transparent state. A Gamma curve 610 is an original Gamma curve, a Gamma curve 620 is a Gamma curve with a decreased upper limit (i.e., the upper limit is not the gray-level "255"), a Gamma curve 630 is a Gamma curve with a decreased intermediate gray-level (i.e., the intermediate gray-level of the Gamma curve is adjusted toward the minimum gray-level "0"). In the present embodiment, when the transparency values Vt indicate that the display data DD corresponds to the pixels displaying the non-transparent state (as presented in the region 310), the image processor 110 transforms the display data DD into the driving data Ddr according to the Gamma curve 620. Namely, all the gray-levels of the driving data Ddr are linearly adjusted to limit the gray-levels corresponding to the non-transparent state to fall within a range from 0 to y, so as to maintain the gradation of the image frame and avoid overflow, where y is a positive integer smaller than 255.

In addition, the decrease of the final gray-level (i.e., the gray-level of the driving data Ddr corresponding to the display data DD having the gray-level "255") of the Gamma curve would also lead to a decreased contrast, and thus, the intermediate brightness (i.e., the intermediate gray-level) of the Gamma curve may be decreased (i.e., adjusted toward the minimum gray-level "0"), so as to calibrate the lost contrast, as presented by the Gamma curve 630. The range of adjusting the intermediate gray-level may vary with the characteristics of the display frame. For example, if the display frame tends to be dark, the adjustment range is small; if the display frame tends to be intermediate, the adjustment range is normal; and if the display frame tends to be bright, the adjustment range is large, but the invention is not limited thereto.

Referring to FIG. 1 again, in another embodiment of the invention, the transparency control signal ST further includes a plurality of gray-level gain values Vg, where one display data DD corresponds to one gray-level gain value Vg, and each gray-level gain value Vg is a multi-bit digital value for representing a decimal value less than 1, such as 0.9, 0.95, 0.8 and so on. When the transparency values Vt indicate that the display data DD corresponds to the transparent state, the image processor 110 sets the corresponding driving data Ddr according to a product of the predetermined gray-level multiplied by the corresponding gray-level gain value Vg, for example, sets each gray-level of the corresponding driving data Ddr to be equal to the product of the predetermined gray-level multiplied by the corresponding gray-level gain value Vg. When the transparency values Vt indicate that the display data DD corresponds to the non-transparent state, the image processor 110 sets the corresponding driving data according to a product of each gray-level corresponding to the display data DD multiplied by the corresponding gray-level gain value, for example, sets each gray-level of the corresponding driving data Ddr to be equal to the product of each gray-level corresponding to the display data DD multiplied by the corresponding gray-level gain value Vg.

The display data DD corresponding to the transparent state may correspond to the same or different gray-level gain values Vg, and the display data DD corresponding to the non-transparent state may correspond to the same or different gray-level gain values Vg, which may be determined by the persons with ordinary skills of the art, and is not limited in the invention.

Figure 7:
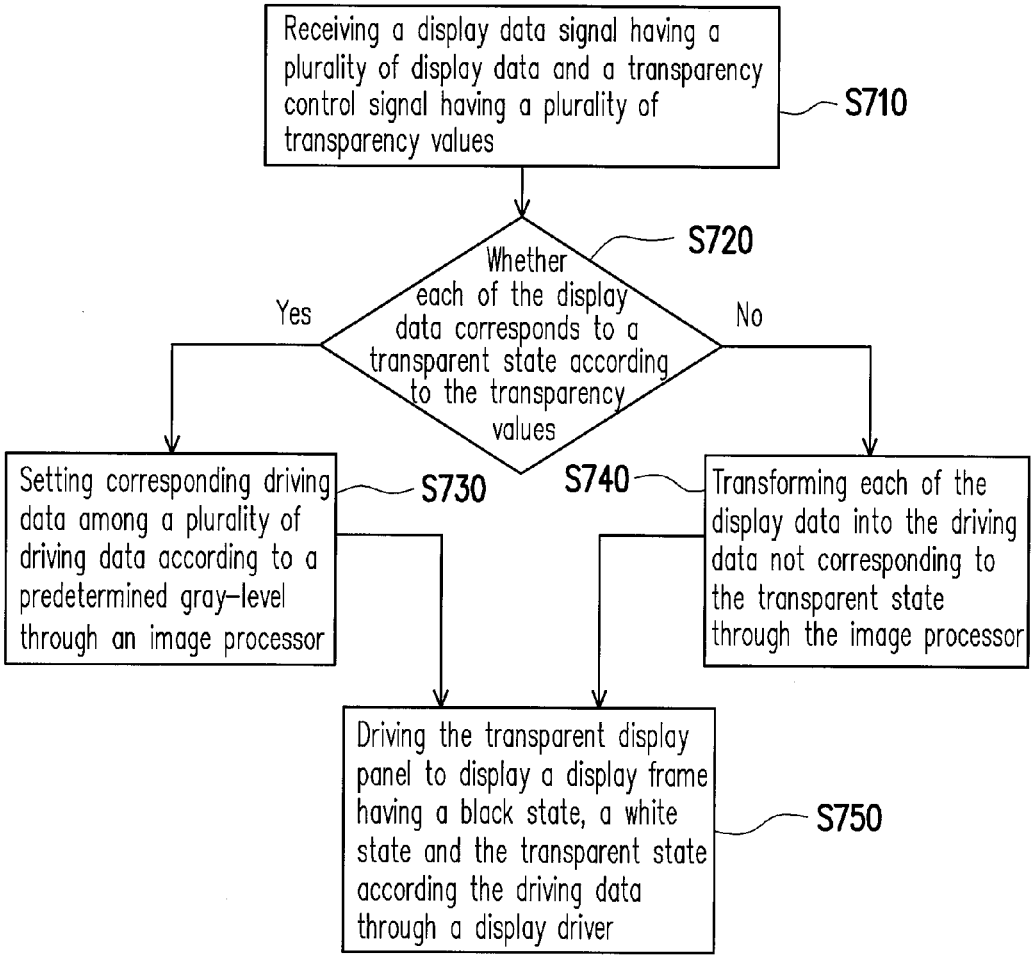
FIG. 7 is a flowchart illustrating a method for driving a transparent display panel according to an embodiment of the invention.

FIG. 7 is a flowchart illustrating a method for driving a transparent display panel according to an embodiment of the invention. Referring to FIG. 7, in the present embodiment, a method for driving the transparent display panel includes the following steps. In step S710, a display data signal having a plurality of display data and a transparency control signal having a plurality of transparency values are received. Then, whether the display data corresponds to a transparent state is determined according to the transparency values (step S720). When each of the transparency values indicates that each of the display data corresponds to a transparent state, i.e., the determination result of step S720 is "Yes", corresponding driving data among a plurality of driving data is set according to a predetermined gray-level through an image processor (step S730). When each of the transparency values indicates that each of the display data corresponds to a non-transparent state, i.e., the determination result of step S720 is "No", each of the display data is transformed into the driving data not corresponding to the transparent state through the image processor (step S740). Lastly, the transparent display panel is driven to display a display frame having a black state, a white state and the transparent state according the driving data through a display driver (step S750). Therein, the sequence of steps S710, S720, S730, S740 and S750 are illustrated for description, but construes no limitations to the invention. Moreover, details with respect to steps S710, S720, S730, S740 and S750 may refer to embodiments illustrated in FIG. 1 to FIG. 6 and thus, will not be repeatedly described.

To summarize, in the transparent display apparatus and the method for driving the transparent display panel thereof provided by the embodiments of the invention, whether the display data corresponds to the transparent state or the non-transparent state can be determined according to the transparency control signal, such that the processing of the display data can be decided, and the driving data can be correspondingly generated. Thereby, the transparent display panel can display the image frame having the black state, the white state and the transparent state to enhance the display effect and the user experiences of the transparent display apparatus.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A transparent display apparatus, comprising:

a transparent display panel;

an image processor, receiving a display data signal having a plurality of display data and a transparency control signal having a plurality of transparency values and a plurality of gray-level gain values to provide a plurality of driving data, wherein when each of the transparency values indicates that each of the display data corresponds to a transparent state, the image processor sets the corresponding driving data according to a predetermined transparent state gray-level, and when each of the transparency values indicates that each of the display data corresponds to a non-transparent state, the image processor transforms each of the display data into the driving data corresponding to the non-transparent state; and a display driver, coupled to the transparent display panel and the image processor to drive the transparent display panel to display a display frame having all gradations of a black state, a white state and the transparent state according the driving data, wherein when each of the transparency values indicates that each of the display data corresponds to the transparent state, the image processor sets the corresponding driving data according to a product of the predetermined transparent state gray-level multiplied by the corresponding gray-level gain value, and when each of the transparency values indicates that each of the display data corresponds to the non-transparent state, the image processor sets the corresponding driving data according to a product of a gray-level of each of the display data multiplied by the corresponding gray-level gain value.

2. The transparent display apparatus according to claim 1, wherein the predetermined gray-level is a gray-level corresponding to the transparent state.

3. A method for driving a transparent display panel, comprising:

receiving a display data signal having a plurality of display data and a transparency control signal having a plurality of transparency values and a plurality of gray-level gain values;

when each of the transparency values indicates that each of the display data corresponds to a transparent state, setting corresponding driving data among a plurality of driving data according to a predetermined gray-level through an image processor;

when each of the transparency values indicates that each of the display data corresponds to a non-transparent state, transforming each of the display data into the driving data not corresponding to the transparent state through the image processor;

driving the transparent display panel to display a display frame having a black state, a white state and the transparent state according the driving data through a display driver, when each of the transparency values indicates that each of the display data corresponds to the transparent state, setting the corresponding driving data according to a product of the predetermined gray-level multiplied by the corresponding gray-level gain value through the image processor; and when each of the transparency values indicates that each of the display data corresponds to the non-transparent state, setting the corresponding driving data according to a product of a gray-level of each of the display data multiplied by the corresponding gray-level gain value through the image processor.

4. The method according to claim 3, wherein the predetermined gray-level is a gray-level corresponding to the transparent state.

* * * * *